United States Patent [19]

Goddard

[11] Patent Number: 4,939,903

[45] Date of Patent: Jul. 10, 1990

[54] REFRIGERANT RECOVERY AND PURIFICATION SYSTEM AND METHOD

[76] Inventor: L. A. Goddard, P.O. Box 697, Hazelhurst, Ga. 31539

[21] Appl. No.: 375,864

[22] Filed: Jul. 5, 1989

[51] Int. Cl.[5] ..... F25B 45/00

[52] U.S. Cl. ..... 62/77; 62/149; 62/292

[58] Field of Search ..... 62/77, 85, 149, 292, 62/150, 474; 141/65

[56] References Cited

U.S. PATENT DOCUMENTS

| | | | |
|---|---|---|---|
| 4,476,688 | 10/1984 | Goddard | 62/292 X |
| 4,646,527 | 3/1987 | Taylor | 62/149 X |
| 4,768,347 | 9/1988 | Manz et al. | 62/149 |
| 4,809,515 | 3/1989 | Houwink | 62/149 |
| 4,809,520 | 3/1989 | Manz et al. | 62/292 |
| 4,856,289 | 8/1989 | Lofland | 62/149 |
| 4,862,699 | 9/1989 | Lounis | 62/149 |
| 4,887,435 | 12/1989 | Anderson, Jr. | 62/292 X |

*Primary Examiner*—Lloyd L. King

*Attorney, Agent, or Firm*—Thomas C. Saitta

[57] ABSTRACT

An apparatus and method for recovering and purifying refrigerant from refrigeration units where the refrigerant is routed through expansion means into the internal coil of a purification unit, causing the coil to cool. The refrigerant exits the coil and is subsequently passed back into the internal chamber of the purification unit, where impurities are condensed onto the cool coil. The purified refrigerant is then passed into storage means.

17 Claims, 2 Drawing Sheets

FIG. 2
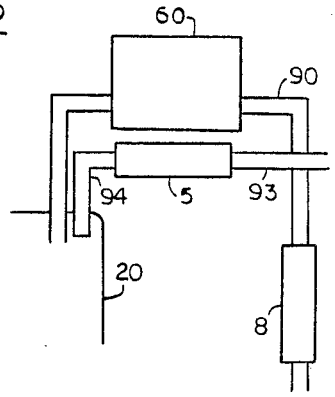
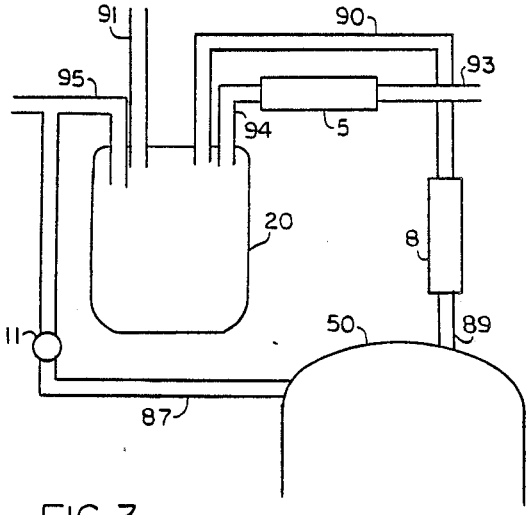
FIG. 3

REFRIGERANT RECOVERY AND PURIFICATION SYSTEM AND METHOD

BACKGROUND OF THE INVENTION

This invention relates generally to a refrigerant recovery and purification system capable of withdrawing refrigerant from a disabled or inoperative refrigeration unit, removing impurities from the refrigerant, cleaning and reconditioning the refrigerant and returning it to the refrigeration unit after repair. The invention relates more specifically to such a system where the inherent cooling potential of the refrigerant is utilized to accomplish one stage of the purification process. The invention further relates to the method of accomplishing the removal and purification where the inherent cooling potential of the refrigerant itself is utilized to purify and cool the refrigerant for storage or replacement into the refrigeration unit.

During the continued operation of a refrigeration system, the refrigerant becomes contaminated with impurities such as moisture, acids and particulate matter. When the system needs repair, the standard practice is to simply bleed the system to atmosphere. This method, however, wastes refrigerant, since it can be cleaned and reused, plus it is now known to be a major source of pollution. The CFC's contained in the refrigerant have been shown to cause major damage to the ozone layer.

Prior art has taught recovery systems which remove the contaminated refrigerant for purification, and it is now known to have systems which both remove and purify the refrigerant. Such systems are then capable of returning the clean refrigerant to the repaired refrigeration system. For example, U.S. Pat. No. 4,476,688 to this inventor teaches such a system. That patent teaches a system comprising a compressor, purification units, a condenser and storage tanks. .Another such system is taught in U.S. Pat. No. 4,646,527 to Taylor. This system also utilizes a compressor, purification units, a condenser and storage tanks.

A major short-coming of the prior systems is that a prime source of thermodynamic energy, that of the refrigerant being removed, is not put to any use and is therefore completely wasted. A second disadvantage is that the systems require a condenser unit to sufficiently cool the refrigerant after purification for storage and replacement in the refrigeration system. This condenser requires outside fans and energy sources to accomplish the cooling task.

It is an object of this invention to provide a method and a refrigerant recovery and purification system, capable of removing and purifying contaminated refrigerant from a refrigeration system and then storing and/or returning this clean refrigerant to the same refrigeration system, where the refrigerant being removed is utilized as a source of energy for a purification step.

It is a further object of this invention to provide such a method and system where the refrigerant is sufficiently cooled by the purification process such that a condenser is not required to be a part of said system.

It is a further object of this invention to provide such a method and system where the refrigerant being removed is allowed to expand and pass through coils contained within a dehydrator-purifier, thereby cooling or freezing the coils. The refrigerant is then forced through the coils and impurities are condensed onto the coils while the clean refrigerant evaporates and continues through the system.

DESCRIPTION OF THE DRAWINGS

FIG. 2 is a partial schematic showing inclusion of a condenser as part of the system.

FIG. 3 is a partial schematic showing inclusion of a relief conduit for the storage tank as part of the system.

DETAILED DESCRIPTION OF THE INVENTION

Figure 1:
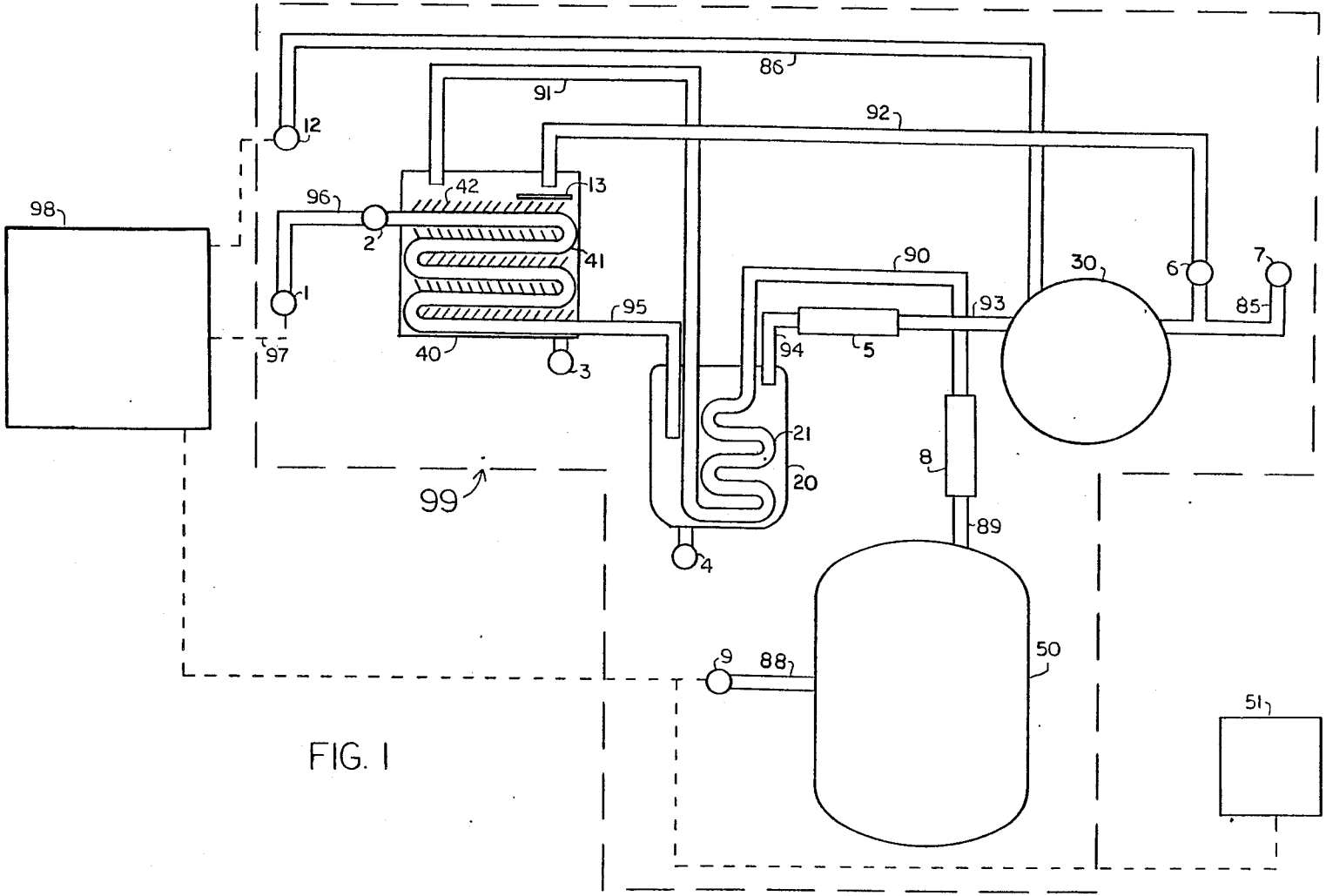
FIG. 1 is a schematic of the invention, showing the relation of the various components and the invention's relation to a refrigeration system.

With reference to FIG. 1, the refrigerant recovery and purification system 99 is shown schematically. The system 99 is connected to a disabled or nonfunctioning refrigeration unit 98 by connecting hose or conduit 97 using standard fittings in a manner well known in the industry. Conduit 97 is connected to input valve 1, which is preferably a ball valve for ease of operation, but can be of any type adjustable valve having a range from full open to completely closed. To allow the withdrawal of refrigerant from refrigeration unit 98, valve 1 is opened and the refrigerant flows through conduit 96 to an expansion means 2. At the outset, there is usually sufficient pressure within refrigeration unit 98 such that the refrigerant flows unaided. When the pressure is relieved to the extent that the refrigerant will not flow automatically, a compressor 30 is activated to withdraw any additional refrigerant from refrigeration unit 98.

Expansion means 2, which can be an expansion valve or any similar device known in the industry, allows the liquid refrigerant to expand to occupy a greater volume, thereby allowing a phase change for some of the refrigerant from liquid to gas. Expansion means 2 is connected to heat exchanger coil 41, which is a component of the dehydrator-purifier 40. Because of the expansion of refrigerant, coil 41 is cooled to a low temperature due to the absorption of heat energy by the refrigerant. The refrigerant is conducted from coil 41 through conduit 95 to oil trap 20, entering into the internal chamber of oil trap 20.

Oil trap 20 is an accumulator for oil, water, acids and other impurities which are contained in the refrigerant. The impurities remain in the bottom of the internal chamber of oil trap 20, where they are periodically drained off through valve 4. Devices of this type are well known in the industry. A coil 21 containing warm or hot gas is also contained in the internal chamber of oil trap 20. This increases the evaporation of refrigerant gas, while the impurities having a much higher boiling point remain in the internal chamber. The refrigerant exits oil trap 20 in the gaseous state through conduit 94, where it is passed through an acid/moisture/particulate purification filter-drier 5. Filter-drier 5 comprises a sintered or compressed core of silica gel, molecular sieve, activated alumina, desiccants or other material, and such filters are well known in the industry. Filter-drier 5 removes any impurities not removed in oil trap 20, such as acid, moisture or foreign particles still remaining in the refrigerant.

From filter-drier 5, the refrigerant travels to compressor 30 through conduit 93. Compressor 30 is required to create a partial vacuum for complete evacuation of the refrigerant from refrigeration unit 98. Compressor 30 also compresses the refrigerant gas, raising the temperature of the refrigerant. To allow the compressor 30 to perform additional functions, conduit 86 is attached to the suction side of compressor 30, such that gas or liquid can be drawn through valve 12 if required. Conduit 85 may be used to route the compressed gas or liquid through purge valve 7 to atmosphere if required. Because of these conduits, the system 99 can be used to withdraw refrigerant in circumstances where purification is not desired. An oil sensor is incorporated in the compressor 30 to detect any loss of lubricating oil.

The hot, high pressure refrigerant gas is now routed through a one-way check valve 6 and conduit 92 back to dehydrator-purifier 40. Dehydrator-purifier 40 is constructed such that conduit 92, the input conduit, releases the refrigerant into the receiving side of the internal chamber of dehydrator-purifier 40. A deflector or baffle means 13 may be positioned to better disperse the refrigerant entering the receiving side of the internal chamber. The internal chamber of dehydrator-purifier 40 is split by coil 41, the low temperature coil resulting from the expansion of the refrigerant initially removed from the refrigeration unit 98, forming a barrier to impede the flow of hot refrigerant. Coil 41 winds back and forth through the middle of the internal chamber of dehydrator-purifier 40. Additionally, fins 42 constructed of a good temperature transfer material, such as but not limited to copper or aluminum, are attached by welding or other suitable means to coil 41, creating a large, low-temperature surface area. In this manner, the hot refrigerant from conduit 92 must pass through the barrier created by coil 41 and fins 42 to reach the discharging side, resulting in substantial cooling or actual freezing of any impurities remaining in the refrigerant, either by virtue of escaping the oil trap 20 and filter-drier 5, or by having been introduced in compressor 30. The impurities solidify on coil 41 and fins 42, while the purified refrigerant gas begins to condense. The purified refrigerant gas, now cooled to some extent by the action of coil 41 and fins 42, exits the discharging side of the internal chamber of dehydrator-purifier 40 through conduit 91.

At the outset of the evacuation of refrigeration unit 98, liquid refrigerant will be removed initially. After the bulk of liquid refrigerant is removed, the refrigerant becomes a liquid-gas mixture and eventually just a gas. As the state of refrigerant changes from liquid to gas, the cooling effect caused by the expansion means 2 will decrease and cease, so that the coil 41 and fins 42 inside the dehydrator-purifier 40 will likewise increase in temperature. This allows the impurities previously solidified onto coil 41 and fins 42 to drip to the bottom of the internal chamber of dehydrator-purifier 40 for removal via valve 3.

Conduit 91 routes the partially condensed refrigerant gas through coil 21 of oil trap 20. Coil 21 is composed of a good heat transfer material, such as but not limited to copper or aluminum. Coil 21 heats the liquid state refrigerant accumulated in the internal chamber of oil trap 20, thereby increasing the evaporation rate of liquid refrigerant contained in the internal chamber and distilling out the impurities, which remain in the oil trap 20. This refrigerant, now in the gaseous state, passes through conduit 94, as previously discussed, leaving only impurities for removal from the oil trap 20. The refrigerant passing through coil 21, now cooled even further due to the heat exchange with the impurities in oil trap 20, is conducted by conduit 90 through a second filter-drier 8, which further removes any trace impurities remaining in the refrigerant.

Where the refrigerant unit 98 is an automotive air conditioner unit, the quantity of refrigerant and the pressures being dealt with are sufficiently low so that no further cooling or condensing of the purified refrigerant is required prior to storage or replacement in the refrigeration unit 98. The use of the cooling capability of the removed refrigerant, coupled with the routing of the refrigerant through the oil trap 20 and filter-drier 8, results in sufficient low temperature and pressure for storage in tank 50. The refrigerant is routed from filter-drier 8 through conduit 89 into tank 50. There it is routed through conduit 88 through check valve 9 back into refrigeration unit 98 or into an external storage tank 51.

In an alternative embodiment, as shown in FIG. 2, a condenser 60 is placed between filter-drier 8 and oil trap 20 on conduit 90. This condenser 60 can be of a type well-known in the art, being of the usual heat exchanger type. For situations where the refrigerant recovery and purification system 99 is used in conjunction with commercial refrigerant units 98, the large amount of refrigerant required to operate the unit 98 and the high pressures accompanying such operation may require use of condenser 60 to achieve sufficient cooling and liquification of the clean refrigerant for storage and replacement. In these situations, the condenser 60 is much smaller than those normally used in conjunction with these systems, since the refrigerant is significantly cooler due to its passage through the cold coil 41 of the dehydrator-purifier 40.

As a further refinement of the refrigerant recovery and purification system 99, conduit 87 may be added to connect storage tank 50 to conduit 95. This conduit 87 contains a pressure relief valve 11, either manual or automatic. Should pressure within storage tank 50 surpass a safe level, relief pressure valve 11 automatically opens, allowing some refrigerant to escape from tank 50 and thus reduces the pressure. This refrigerant is routed back through the system by compressor 30 and ultimately returns to storage tank 50.

The above description, illustrations and embodiments are by way of example only, and it is understood that one skilled in the art could readily adopt obvious substitutions and equivalents of like elements into the system. The full scope and definition of the invention therefore is as set forth in the following claims.

I claim:

1. An apparatus for recovering and purifying refrigerant from a refrigeration unit comprising:

compressor means for withdrawing said refrigerant from said refrigeration unit;

storage means for storing said refrigerant;

purification means comprising an internal chamber, said chamber being divided by an internal coil into a receiving side and a discharging side, ingress means for said refrigerant into the receiving side, exit means for said refrigerant from the discharging side, whereby said refrigerant must contact said coil when passing from the receiving side to the discharging side;

expansion means adjacent said interior coil;

conduit means connecting said refrigerant unit to said expansion means whereby said refrigerant flows from said refrigeration unit through said expansion means and into said internal coil;

conduit means connecting said internal coil to said compressor whereby said refrigerant flows form said internal coil into said compressor;

conduit means connecting said compressor to said ingress means of said purification means whereby said refrigerant flows from said compressor through said ingress means;

conduit means connecting said exit means of said purification means to said storage means.

2. The apparatus of claim 1, further comprising:

accumulator means comprising an internal chamber, ingress means for said refrigerant to enter said accumulator internal chamber, exit means for said refrigerant to leave said accumulator internal chamber, and a coil disposed in said accumulator internal chamber;

where said accumulator means is interposed on said conduit means connecting said internal coil of said purification means to said compressor, whereby said refrigerant flows from said internal coil of said purification means through said accumulator ingress means into said accumulator internal chamber and then through said accumulator exit means into said compressor;

and where said accumulator coil is interposed on said conduit means connecting said exit means of said purification means to said storage means, whereby said refrigerant flows from said exit means of said purification means through said accumulator coil and into said storage means.

3. The apparatus of claim 2, further comprising:

filter means interposed on said conduit means connecting said accumulator exit means and said compressor.

4. The apparatus of claim 3, further comprising:

filter means interposed on said conduit means connecting said accumulator coil and said storage means.

5. The apparatus of claim 1, further comprising:

conduit means connecting said storage means to said refrigeration unit, whereby said refrigerant flows from said storage tank into said refrigeration unit.

6. The apparatus of claim 2, further comprising:

conduit means connecting said storage means to said accumulator ingress means, whereby said refrigerant flows from said storage means into said accumulator ingress means.

7. The apparatus of claim 2, further comprising:

condenser means interposed on said conduit means connecting said accumulator coil to said storage means, whereby said refrigerant flows from said accumulator coil through said condenser means and into said storage means.

8. The apparatus of claim 1, further comprising:

heat transfer fins attached to said coil of said purification means.

9. The apparatus of claim 1, further comprising:

deflector means in said receiving side of said purification means, whereby said refrigerant flowing into said receiving side is dispersed.

10. A method for recovering and purifying refrigerant from a refrigeration unit, comprising the steps of:

providing purification means having an internal chamber and an internal coil, expansion means adjacent said internal coil, compressor means, storage means and conduit means for passage of said refrigerant;

passing said refrigerant from said refrigeration unit through said expansion means and into said internal coil thereby causing said internal coil to cool;

subsequently passing said refrigerant from said internal coil into said compressor;

subsequently passing said refrigerant from said compressor into said internal chamber, thereby externally contacting said refrigerant against said internal coils;

subsequently passing said refrigerant from said internal chamber into said storage means.

11. The method of claim 10, further comprising the steps of:

providing accumulator means having an internal chamber and a coil disposed in said internal chamber;

passing said refrigerant from said internal coil of said purification means into said accumulator internal chamber and then into said compressor;

passing said refrigerant from said internal chamber of said purification means through said accumulator coil and into said storage means.

12. The method of claim 11, further comprising the steps of:

providing filter means;

passing said refrigerant from said accumulator internal chamber through said filter means and into said compressor.

13. The method of claim 12, further comprising the steps of:

providing additional filter means;

passing said refrigerant from said accumulator coil through said additional filter means and into said storage means.

14. The method of claim 10, further comprising the step of:

passing said refrigerant from said storage means int said refrigeration unit.

15. The method of claim 11, further comprising the step of:

passing said refrigerant from said storage means into said accumulator internal chamber.

16. The method of claim 10, further comprising the steps of:

providing condenser means, passing said refrigerant from said accumulator coil through said condenser means and into said storage means.

17. The method of claim 11, further comprising the steps of:

providing condenser means, passing said refrigerant from said accumulator coil through said condenser means and into said storage means.

* * * * *